US006079717A

United States Patent [19]

Meester et al.

[11] Patent Number: 6,079,717

[45] Date of Patent: Jun. 27, 2000

[54] CLAP SKATE

[75] Inventors: Frank A. J. Meester; Hans Meester, both of Leiden, Netherlands

[73] Assignee: Viking Schaatsenfabriek B.V., Weesp, Netherlands

[21] Appl. No.: 09/166,762

[22] Filed: Oct. 5, 1998

[30] Foreign Application Priority Data

Oct. 8, 1997 [NL] Netherlands ..... 1007231

[51] Int. Cl.[7] ..... A63C 1/28

[52] U.S. Cl. ..... 280/11.12; 280/11.14; 280/11.15; 280/11.32; 280/11.28

[58] Field of Search ..... 280/11.14, 11.15, 280/11.18, 11.28, 11.115, 11.12, 11.3, 11.32, 626, 631, 615

[56] References Cited

U.S. PATENT DOCUMENTS

| | | | |
|---|---|---|---|
| 4,245,848 | 1/1981 | Dudouyt | 280/11.28 |
| 5,257,793 | 11/1993 | Fortin | 280/11.12 |
| 5,503,413 | 4/1996 | Belogour | 280/11.28 |
| 5,718,438 | 2/1998 | Cho | 280/11.27 |
| 5,823,543 | 10/1998 | Burns et al. | 280/11.28 |
| 5,941,539 | 8/1999 | Pratt | 280/11.27 |
| 5,961,131 | 10/1999 | Hilgarth | 280/11.28 |
| 5,979,916 | 11/1999 | Gatel et al. | 280/11.28 |
| 6,007,075 | 12/1999 | Shum | 280/11.12 |

FOREIGN PATENT DOCUMENTS

| | | | |
|---|---|---|---|
| 0 559 179 A1 | 9/1993 | European Pat. Off. . | |
| 11104288A | 4/1999 | Japan . | |
| WO 96/37269 | 11/1996 | WIPO | 280/11.15 |

*Primary Examiner*—Lanna Mai
*Assistant Examiner*—Ruth Ilan
*Attorney, Agent, or Firm*—Foley, Hoag & Eliot, LLP

[57] ABSTRACT

A clap skate, including a frame having a forefoot support and a heel support, wherein said frame is pivotally connected to the forefoot support about a transverse pivot pin, which allows the frame to swing away from the heel, and wherein a spring is provided which causes the frame to return. The pivotable connection between the forefoot support and the frame is carried out as an adjustable friction swivel joint.

5 Claims, 2 Drawing Sheets

CLAP SKATE

FIELD OF THE INVENTION

The invention relates to skates of the type, with which the skater's foot may tilt forwardly relative to the skate frame while the latter is holding contact with the "ice" surface, and with which the skate frame returns to its normal or starting position relative to the skater's foot as soon as it is taken off the (ice) surface. The term "clap skate" is meant to cover both ice skates and inline roller skates (also called "skeelers"). Both of this clap skate versions are known. Especially the ice skate version has become very popular.

BACKGROUND OF THE INVENTION

In the type of skate to which the invention relates, the skate frame has a forefoot support and a heel support. The forefoot support is pivotally connected to the frame about a transverse pivot pin. A forward tilting movement of the skater's foot relative to the skate frame, while the latter is in contact with the (ice) surface, is taking place against the action of a spring. Thus said spring tends to force the skate frame to return to its normal position relative to the skater's foot (i.e. with the heel of the foot resting on the fixed heel support) as soon as the skate frame is taken off the (ice) surface at the end of the skater's push.

Thus the pivot connection between the frame and the forefoot support allows the skater's foot to turn away from the skate frame and thereby stretch completely during the skater's push being applied onto the (ice) surface. As a result of this the skater's push is optimalized.

The reinstatement of the contact between the fixed heel support and the heel at the end of the return movement is accompanied by a blow or "clap".

Depending on the angle, through which the skate frame as turned away during the push phase, the returning movement will take place with more or less force and consequently with a more or less powerful clap.

OBJECT AND SUMMARY OF THE INVENTION

It is a principle object of the invention to provide a means for adjusting the force with which the return movement is taking place and thereby to fill a need with the individual skater for such provision, which need is more particularly felt in competitive speed skating. According to the invention this object is obtained by constructing the pivotable connection between the forefoot support and the frame as an adjustable friction swivel joint. A further object of the invention is to provide an adjustable friction swivel joint of a simple and reliable construction.

Another object of the invention is to provide an adjustable friction swivel joint which can be easily adjusted by the skater himself.

Further objects and advantages of the invention will be hereinafter further explained by way of example with reference to the accompanying drawing.

DESCRIPTION OF THE PREFERRED EMBODIMENT

Figure 1:
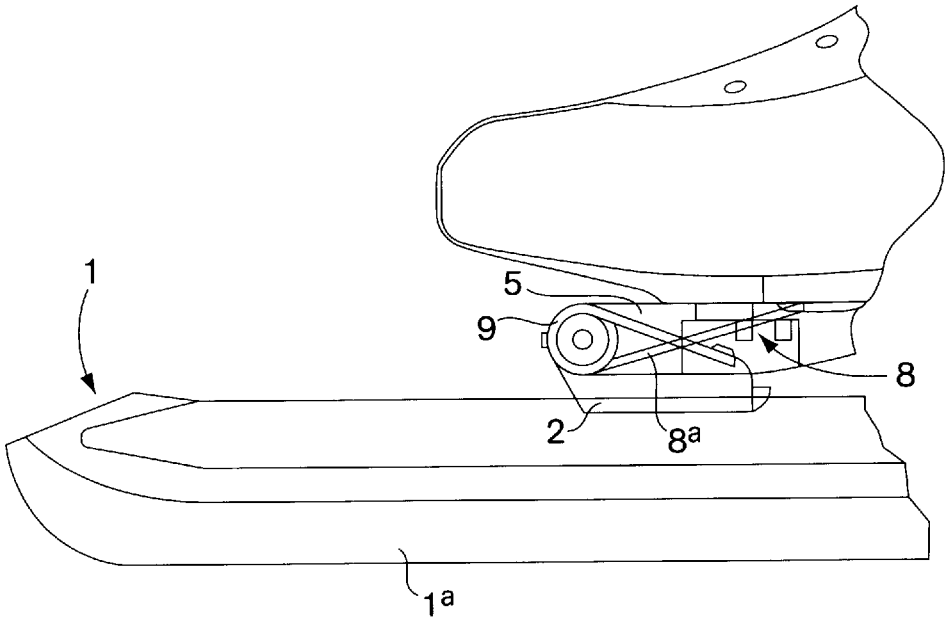
FIG. 1 is a side view of the front part of a clap skate/shoe combination, in the normal position, wherein the pivot connection between the frame of the skate and the forefoot support is shown in cross-section.
Figure 2:
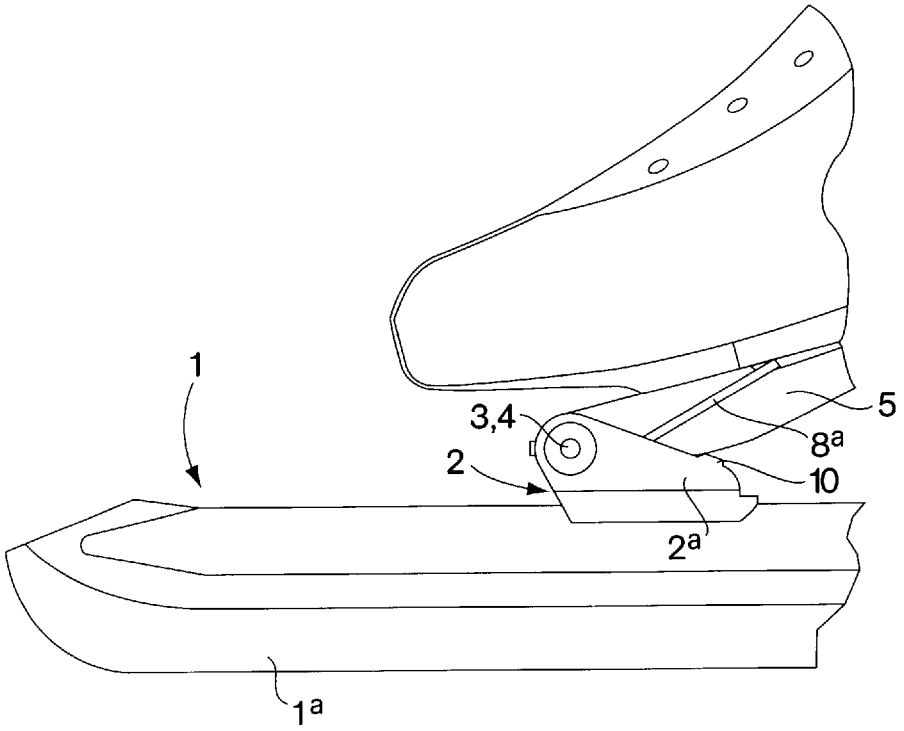
FIG. 2 is a side view of the combination of FIG. 1, but with the shoe in a forewardly tilted position relative to the frame of the skate.

With reference to FIGS. 1 and 2 is the front part of the tubular skate frame holding the sliding blade 1*a* of a speed skate of the "Norwegian" type.

Figure 3:
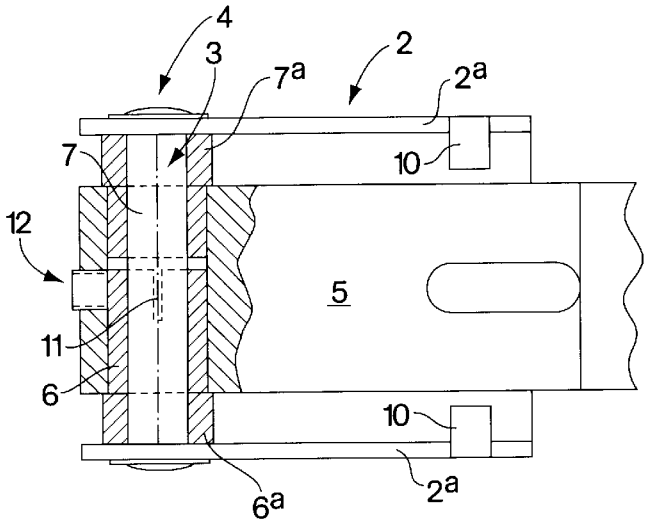
FIG. 3 is a plan view of the forefoot support upon removal of the shoe, and partially in horizontal cross-section through the pivot connection.
Figure 5:
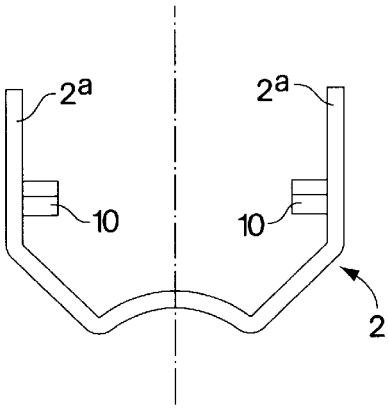
FIG. 5 is a front view of the bracket, in which the forefoot support is pivotally mounted.
Figure 4:
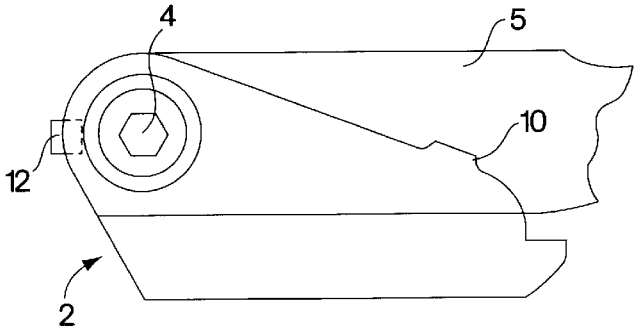
FIG. 4 is a side view of the forefoot support of FIG. 3.

A bracket 2 is fastened, e.g. by soldering, onto the frame 1 (see also FIG. 3–5). A pivot pin 3 is fixedly, but removably connected between the two flanges 2*a* of bracket 2 by means of a fastening screw 4 extending through said pivot pin.

A forefoot support 5 adapted to be fastened to a skating shoe is rotatably mounted on said pin 3. For this purpose bearing bushes 6 and 7 are fixedly mounted in a bore of the forefoot support 5. The bearing bush 6 has a larger length than the bearing bush 7 and extends beyond halfway the width of the forefoot support.

The outer ends of the bearing bushes 6 and 7 project beyond the respective ends of the forefoot support and are widened to form collars 6*a* and 7*a* respectively, which collars slidingly engage the inner side of the respective bracket flanges 2*a*.

In the normal travelling position shown in FIG. 1, the heel portion (not shown) of the shoe is supported on a fixed heel support (not shown either) on the rear part of the frame 1.

Due to the pivot connection described hereinabove the skating shoe fastened onto the forefoot support 5 may turn from the position shown in FIG. 1 towards the position shown in FIG. 2. This movement, which occurs particularly in the last phase of the push exerted with the skate under skating conditions, is taking place against the action of a spring 8 (see FIGS. 1 and 2). The spring 8 is constituted by an U-shaped spring wire, the cross portion of which engages the upper face of the forefoot support 5 and the legs 8*a* of which are provided with helically wound portions 9, which are positioned about the collar portions 6*a* and 7*a* of the bearing bushes 6 and 7. The free end portions of the spring 8 are held by prongs 10 which extend from the bracket flanges 2*a* inwardly.

As soon as the skate/shoe combination gets off the ice at the end of the push, the spring 8 causes the combination to return to the position shown in FIG. 1.

In order to enable controlling of the strength, with which the returning movement is taking place, the friction between the pivot pin 3 and the bearing bush 6 can be adjusted. For this purpose the bearing bush 6 is provided with two axial cuts 11, which start from the inner end of said bearing bush 6. Said cuts 11 take diametrically opposed positions in a plane perpendicular to that of the drawing (FIG. 3) and render the respective end portion of the bearing bush 6 elastically deformable.

12 is an adjustment screw provided on the front side in a cross bore in the forefoot support 5, said adjustment screw having its inner end in press contact with the elastically deformable end portion of the bearing bush 6. It will be understood that by tightening the adjustment screw 12 with more or less force, the end portion of the bearing bush will be pressed with corresponding force onto the pivot pin 3, so that the friction between the pivot pin and said bearing bush will be correspondingly increased or decreased respectively.

As shown in the preferred embodiment of FIG. 3, the adjustment screw 12 is in the form of a so-called "threaded worm", which may have a blind socket hole for receiving a hex key.

The structure described hereinabove enables the individual skater to simply adjust the strength and the "clap", with which the returning movement is taking place, according to his personal need.

The material of the bearing bush 6 will have to be both elastically deformable and have the required antifriction properties. A suitable material is a plastic material, known under the trade name "DELRIN™".

What is claimed and desired to be secured by Letters Patent of the United States of America is:

1. A clap skate, comprising:

a frame for holding surface contacting displacement means;

a heel support for the heel portion of a skating shoe, said heel support being fixedly mounted on a rear part of said frame;

a forefoot support adapted for fastening the sole portion of said skating shoe thereon, said forefoot support being pivotally connected to a front part of said frame about a transverse pivot pin, so as to allow said forefoot support with the skating shoe thereon to be tilted about said pivot pin forwardly from a normal position, whereby the skating shoe is lifted with its heel portion from said fixedly mounted heel support;

a spring means tending to cause said forefoot support with the skating shoe thereon to return into said normal position, with the heel portion of the skating shoe resting on said heel support;

wherein said pivotal connection between said frame and said forefoot support is in the form of an adjustable frictional swivel joint;

and wherein said pivot pin is fixedly mounted to said frame and extends through a bearing bush that is mounted in a cross-bore of the forefoot support, said bearing bush having an elastically deformable circumferential portion, that cooperates with a press member engaging said circumferential portion, said press member being mounted in said forefoot support for adjustment in a direction which is transverse to the axis of the pivot pin.

2. A clap skate according to claim 1, wherein said elastic elastically deformable circumferential portion of said bearing bush is confined by axially directed cuts.

3. A clap skate according to claim 2, wherein said bearing bush comprises two separate bearing bushes, one bush of which extends through more than halfway the length of the pivot pin and comprises said cuts, which extend from the inner terminal edge of said one bush, the adjustable press member being formed by an adjustment screw, which is positioned to be operable from the front side of the forefoot support.

4. A clap skate according to claim 3, wherein said adjustment screw is provided with a blind socket cavity for applying a hex key.

5. A clap skate according to claim 1, wherein said surface contacting displacement means are constituted by a sliding blade.

* * * * *